US010633820B2

(12) United States Patent
Congdon et al.

(10) Patent No.: US 10,633,820 B2
(45) Date of Patent: Apr. 28, 2020

(54) CUTTER FOR DOZING BLADE ASSEMBLY AND BODY SECTION FOR SAME

(71) Applicant: Caterpillar Inc., Peoria, IL (US)

(72) Inventors: Thomas Congdon, Dunlap, IL (US); Nathan Bjerke, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 233 days.

(21) Appl. No.: 15/787,810

(22) Filed: Oct. 19, 2017

(65) Prior Publication Data

US 2018/0179730 A1 Jun. 28, 2018

Related U.S. Application Data

(60) Provisional application No. 62/438,242, filed on Dec. 22, 2016.

(51) Int. Cl.

| | |
|---|---|
| ***E02F 3/815*** | (2006.01) |
| ***E01H 5/06*** | (2006.01) |
| ***E02F 3/76*** | (2006.01) |
| *E02F 9/28* | (2006.01) |
| *F41H 11/28* | (2011.01) |

(52) U.S. Cl.

CPC ..... *E02F 3/8152* (2013.01); *E01H 5/065* (2013.01); *E02F 3/7618* (2013.01); *E01H 5/061* (2013.01); *E02F 9/2883* (2013.01); *F41H 11/28* (2013.01)

(58) Field of Classification Search

CPC . E02F 3/76; E02F 3/7618; E02F 3/815; E02F 3/8152; E02F 3/658; E02F 9/28; E02F 9/2883; E02F 9/2875

See application file for complete search history.

(56) References Cited

U.S. PATENT DOCUMENTS

| | | | | |
|---|---|---|---|---|
| 2,732,639 | A | 1/1956 | Lillengreen | |
| 3,029,534 | A * | 4/1962 | Rakisits | E02F 3/8152 172/701.2 |
| 4,086,967 | A * | 5/1978 | Eftefield | E02F 3/8152 172/701.2 |
| 6,470,606 | B1 | 10/2002 | Nagahiro et al. | |
| D534,929 | S * | 1/2007 | Matsumoto | D15/32 |
| 7,874,085 | B1 | 1/2011 | Winter et al. | |
| 8,272,451 | B2 | 9/2012 | Ditzler | |
| 8,602,122 | B2 | 12/2013 | Congdon et al. | |
| 8,783,376 | B2 | 7/2014 | Congdon et al. | |
| 9,290,898 | B2 | 3/2016 | Abramczyk et al. | |
| 2005/0098332 | A1 * | 5/2005 | Matsumoto | E02F 3/7618 172/811 |

(Continued)

FOREIGN PATENT DOCUMENTS

| | | |
|---|---|---|
| CN | 203716202 | 7/2014 |

*Primary Examiner* — Jessica H Lutz
(74) *Attorney, Agent, or Firm* — Jonathan F. Yates

(57) ABSTRACT

A dozing blade assembly includes a dozing blade and a multi-piece cutter mounted to the dozing blade and including an elongate body having a first outer body piece and a second outer body piece that are mirror images of one another, and each including an inboard stem having a linear leading edge profile, and an integral outboard end bit having a curvilinear leading edge profile. The outer body pieces are structured for mounting to the dozing blade such that digging faces of the outer body pieces are oriented at a shallower angle than digging faces of the middle body piece, relative to a horizontal plane.

20 Claims, 4 Drawing Sheets

(56) References Cited

U.S. PATENT DOCUMENTS

| | | | | |
|---|---|---|---|---|
| 2011/0024142 | A1* | 2/2011 | Ditzler | E02F 3/7618 172/701.1 |
| 2014/0041886 | A1* | 2/2014 | Congdon | E02F 3/8152 172/701.3 |
| 2015/0060097 | A1 | 3/2015 | Biggs et al. | |
| 2016/0040399 | A1 | 2/2016 | Congdon et al. | |

* cited by examiner

CUTTER FOR DOZING BLADE ASSEMBLY AND BODY SECTION FOR SAME

TECHNICAL FIELD

The present disclosure relates generally to bolt-on cutting edges for dozing blade assemblies, and more particularly to a cutter for a dozing blade assembly having varied orientations among digging faces of the cutter.

BACKGROUND

Dozing blades are used in tractor implement systems in many different applications. The capability of pushing loose material about a worksite in construction, waste handling, and all manner of natural resource and mining applications is indispensable. Tractors equipped with dozing blades are also used to dig material from a substrate. In many instances, small- to medium-size tractors are used more for moving loose material, while larger and more powerful machines may be used for digging material from a substrate, also known as "production dozing." The basic structure of a dozing blade includes a frame structured for mounting to actuators and supports in the tractor's implement system, a moldboard supported by the frame that interacts with loose material that may be cut or scraped from an underlying substrate by way of a replaceable cutting edge or cutter. Dozing blades and their components are typically configured at least in part on the basis of the anticipated application. Such purpose-building has led to numerous different commercially available dozing blade and cutting edge geometries.

Engineers are continually seeking ways to expand the capabilities of tractors of all sizes, and for this and other reasons there continues to be significant research and development in relation to the design of dozing blades, the control of dozing blades and the related implement system, as well as materials and construction of the replaceable cutting edges or cutters commonly mounted upon a lower edge of a dozing blade. Those skilled in the art will be familiar with the variety of designs for dozing blades themselves, as well as the cutting edges mounted on dozing blades that actually cut, fracture, and/or dig the substrate material. Commonly owned U.S. Pat. No. 8,602,122 to Congdon et al. is directed to a track-type tractor, dozing blade assembly, and dozing blade with a steep center segment. In Congdon et al., a cutter for a dozing blade has a compound digging face with a steeply oriented center segment, and shallowly oriented outer segments, for optimizing the manner in which the dozing blade assembly moves through a material of a substrate.

SUMMARY OF THE INVENTION

In one aspect, a dozing blade assembly includes a dozing blade having a plurality of rearward positioned mounts for coupling the dozing blade with an implement system in a tractor, and a moldboard facing a forward direction. The moldboard has an upper edge and a lower edge each extending in a horizontal direction, a first outboard edge, and a second outboard edge, and the moldboard forming a concave vertical profile. The dozing blade further includes a substantially planar mounting surface extending along the lower edge and oriented at a uniform angle relative to a horizontal plane. A cutter is supported upon the mounting surface and includes an elongate body having a middle body piece, a first outer body piece and a second outer body piece positioned on opposite outboard sides, respectively, of the middle body piece. The first outer body piece and the second outer body piece are mirror images of one another, and each includes an inboard stem having a linear leading edge profile, and an outboard end bit having a curvilinear leading edge profile that transitions with the linear leading edge profile of a corresponding inboard stem. The middle piece includes a middle digging face oriented at a steeper angle relative to a horizontal plane, and the first outer body piece and the second outer body piece including, respectively, a first outer digging face and a second outer digging face positioned upon the corresponding inboard stem and each oriented at a shallower angle relative to the horizontal plane.

In another aspect, a cutter for a dozing blade in an implement system includes an elongate body having a middle body piece, a first outer body piece, and a second outer body piece. The middle body piece includes a middle digging face, a middle mounting face opposite the middle digging face, a leading edge, and a trailing edge. The first outer body piece and the second outer body piece include, respectively, a first outer digging face and a second outer digging face, and a first outer mounting face and a second outer mounting face positioned opposite to the first outer digging face and the second outer digging face. The first outer body piece and the second outer body piece are mirror images of one another, and each includes an inboard stem having a linear leading edge profile, and an outboard end bit having a curvilinear leading edge profile that transitions with the linear leading edge profile of the corresponding inboard stem. The middle digging face is oriented at a smaller angle relative to the middle mounting face, and each of the first outer digging face and the second outer digging face are oriented at a larger angle relative to the corresponding first outer mounting face and second outer mounting face, such that the middle digging face is more steeply inclined to a horizontal plane than the first outer digging face and the second outer digging face when the cutter is mounted in a service configuration upon a substantially planar mounting surface of the dozing blade.

In still another aspect, a body section for a cutter in a dozing blade assembly of an implement system includes an elongate inboard stem including a digging face extending between a leading edge and a trailing edge, an inboard mounting face positioned opposite to the digging face, and a plurality of mounting apertures extending between the digging face and the mounting face to receive a plurality of mounting elements for mounting the body section upon a mounting surface of a dozing blade. The body section further includes an outboard end bit including a forward face adjoining the digging face of the elongate stem and extending between a leading edge and a trailing edge, and an outboard mounting face positioned opposite to the forward face and coplanar with the inboard mounting face. The elongate stem further has a linear leading edge profile, and the outboard end bit is formed integrally with the elongate stem and has a curvilinear leading edge profile that transitions with the linear leading edge profile.

DETAILED DESCRIPTION

Figure 1:
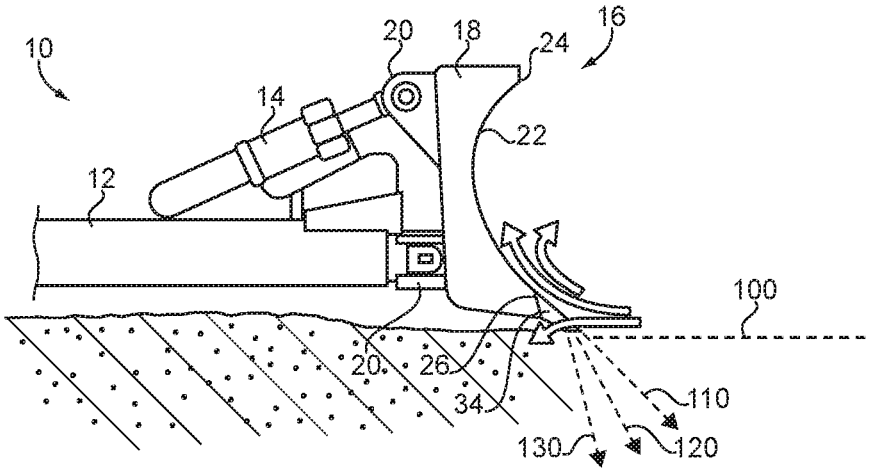
FIG. 1 is a side diagrammatic view of an implement system, according to one embodiment.

Referring to FIG. 1, there is shown a dozing blade assembly 16 in an implement system 10 for a tractor, such as a track-type tractor. Implement system 10 may include a set of push arms, extending forwardly from a machine frame (not shown), one of the push arms being visible in FIG. 1 and shown via reference numeral 12. A tilt actuator 14 is also shown, with push arm 12 and tilt actuator 14 being coupled with a plurality of rearward positioned mounts 20 of a dozing blade 18. Implement system 10 may be operated to position dozing blade 18 anywhere in a range of tilt angles and a range of pivot angles relative to an underlying substrate, that in the FIG. 1 illustration is relatively level and provides a horizontally extending surface. Dozing blade 18 further includes a moldboard 22 facing a forward direction, with moldboard 22 having an upper edge 24 and a lower edge 26. Implement system 10 is shown as it might appear positioned for forward movement across the underlying substrate to push loose material, such as soil, sand, construction debris, rock gravel, forestry slash, or still another loose material across the surface of the substrate, or alternatively to dig material from the substrate itself. It is contemplated that implement system 10 is advantageously configured for a wide variety of applications, including digging or production dozing, site cleanup such as by pushing loose material, or so-called finish dozing, for reasons which will be further apparent from the following description.

Figure 2:
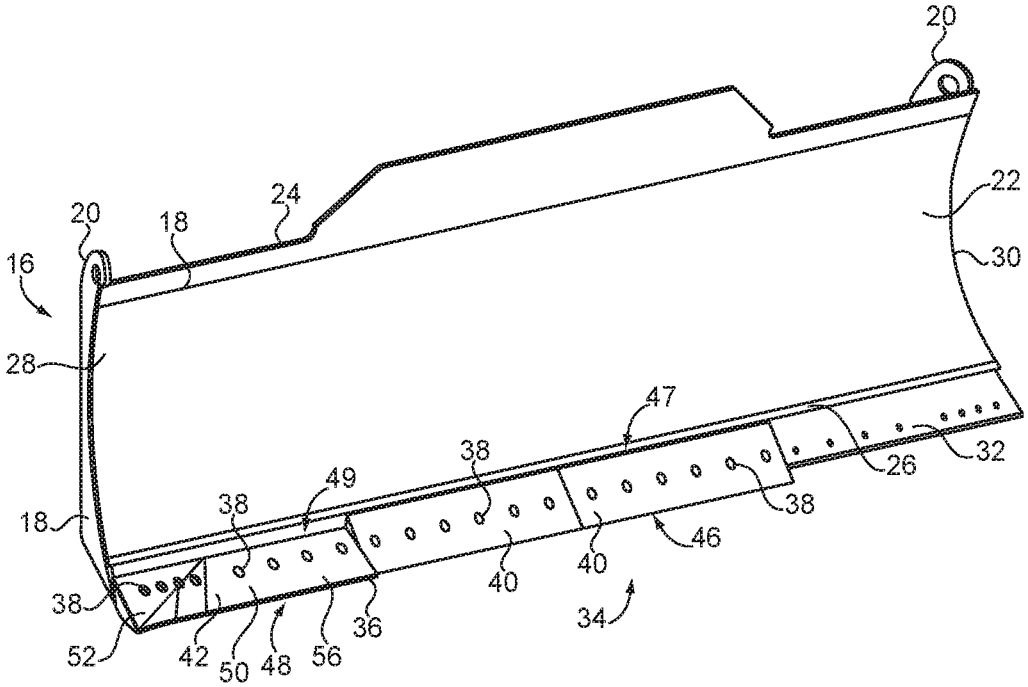
FIG. 2 is a diagrammatic view, partially disassembled, illustrating a dozing blade assembly, according to one embodiment.

Referring also now to FIG. 2, there is shown a dozing blade assembly 16 that includes dozing blade 18, and where it can be seen the moldboard includes a first outboard edge 28 and a second outboard edge 30 that extend generally in a vertical direction, and further that upper edge 24 and lower edge 26 each extend in a generally horizontal direction. Moldboard 22 forms a concave vertical profile. The term "horizontal" and the term "vertical" and other terms relating to directional parameters may be understood in reference to the structure of dozing blade 18. In other words, directional parameters in relation to dozing blade 18 may be defined by dozing blade 18 itself. A horizontal direction, or a horizontal plane as further discussed herein, may be self-defined by dozing blade 18 based upon a service orientation of dozing blade 18. If dozing blade assembly 16 (hereinafter "assembly 16") were rested upon level ground with upper edge 24 positioned vertically above lower edge 26, a horizontal plane as discussed herein would extend generally in forward and rearward directions, as depicted by way of horizontal plane 100 shown in FIG. 1. A vertical direction or a vertical plane would be oriented orthogonally to horizontal plane 100. If assembly 16 were rotated or tipped back approximately 90 degrees from the orientation depicted in FIG. 1 such that upper edge 24 and lower edge 26 were positioned at equivalent heights above a level ground surface, a horizontal direction or horizontal plane would extend generally vertically and orthogonally to the level ground surface. The terms "outboard" and "inboard" are understood herein, respectively, to mean away from a fore-to-aft centerline through dozing blade 18 and toward one or the other of first outboard edge 28 or second outboard edge 30, and away from one or the other of first outboard edge 28 or second outboard edge 30 and toward the fore-to-aft centerline. The terms "forward" and "rearward" can be understood, again in relation to the structure of assembly 16, to the right in FIG. 1 and to the left in FIG. 1, respectively.

Dozing blade 18 further includes a substantially planar mounting surface 32 extending along lower edge 26 and oriented at a uniform angle relative to a horizontal plane 100. In an implementation, mounting surface 32 may be slightly inset or recessed relative to the concave vertical profile of moldboard 22, to provide a relatively smooth transition from digging faces of a cutter 34 supported upon mounting surface 32 and a material molding surface of moldboard 22. In the embodiment shown in FIG. 2 cutter 34 includes an elongate multi-piece body 36 having a middle body piece 40, a first outer body piece 42 and a second outer body piece 44, discussed below, that has been removed and is not visible in FIG. 2. A plurality of mounting apertures in the nature of bolt holes 38 extend through each of the pieces or sections of elongate body 36 for bolting dozing blade 18 upon mounting surface 32 by way of a plurality of bolts or other suitable fastening elements. As noted, elongate body 36 may include a plurality of separate pieces, however, the description herein of "pieces" should not necessarily be taken to mean that the individual body pieces are not attached to one another. Embodiments are contemplated where each of the separate body pieces in elongate body 36 are separate components and each a single unitary piece, as well as embodiments where some of those body pieces are separate components and others are formed integrally with one another as a single piece. In FIG. 2, for instance, middle body piece 40 is shown to have two halves, however, these two separate pieces could be integrated into one center piece, or made as more than two pieces. Middle body piece 40 may include a leading edge 46 and an opposite trailing edge 47. First outer body piece 42 may include a leading edge 48 and a trailing edge 49.

Figure 3:
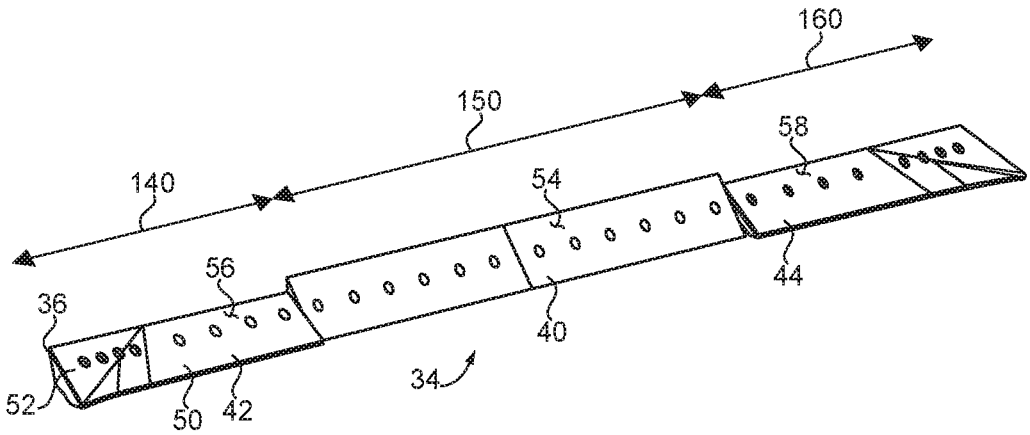
FIG. 3 is a diagrammatic view of a cutter for a dozing blade, according to one embodiment.

Referring also now to FIG. 3, first outer body piece 42 and second outer body piece 44 are mirror images of one another. Much of the present description includes reference to and discussion of features of first outer body piece 42. It will nevertheless be appreciated that the description relating to first outer body piece 42 can be analogously understood in reference to second outer body piece 44, in view of the mirror image relationship. First outer body piece 42 includes an inboard stem 50 having a linear leading edge profile, and an outboard end bit 52 having a curvilinear leading edge profile that transitions with the linear leading edge profile of inboard stem 50. Middle body piece 40 may also have a linear leading edge profile, however, as can be noted from the drawings, the linear leading edge profile of stem 50 may be parallel to the linear leading edge profile of middle body piece 40, but does not transition with that linear leading edge profile in the embodiment shown.

Middle body piece 40 further includes a middle digging face 54 oriented at a steeper angle relative to a horizontal plane, and first outer body piece 42 and second outer body piece 44 include, respectively, a first outer digging face 56 and a second outer digging face 58, positioned upon the corresponding inboard stem 50, and each oriented at a shallower angle relative to the horizontal plane. The different steepnesses of digging face 54 in comparison with digging faces 56 and 58 enable balancing of forward pushability and downward penetration of cutter 34 and thus dozing blade 18 through material. As further discussed herein, variations to the relative difference in steepness, relative lengths of the various body pieces of cutter 34, and potentially other factors can enable one to tune cutter 34 for different applications. For instance, a relatively steeper middle section and/or a relatively longer middle section could bias the balance toward downward penetration, whereas a relatively shallower and/or relatively shorter middle section could bias the balance more toward forward pushability. In FIG. 3, first outer body section 42 includes a horizontal length 140, second outer body section 44 includes a horizontal length 160, and middle body section 40 includes a horizontal length 150. Length 140 and length 160 may be equal to one another, and may each be less than length 150. In a practical implementation strategy, each length 140 and 160 may be from about 25 percent to about 33 percent of a total sum horizontal length of cutter 34.

Figure 4:
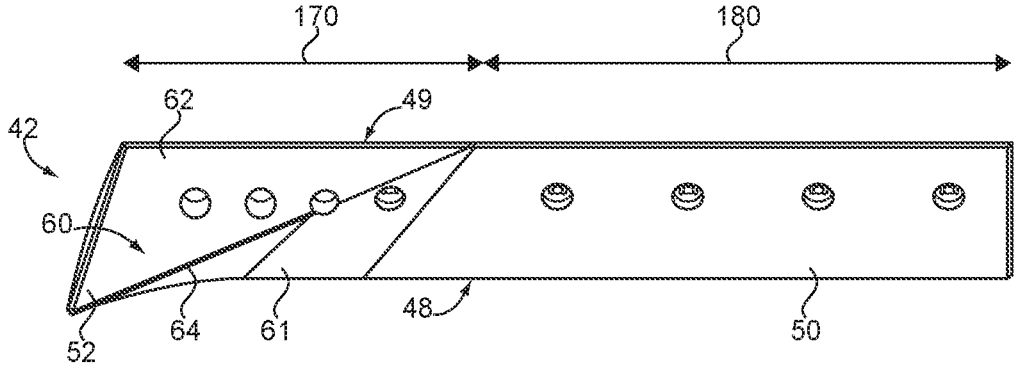
FIG. 4 is a diagrammatic view of a body piece for a cutter in a dozing blade assembly, according to one embodiment.
Figure 6:
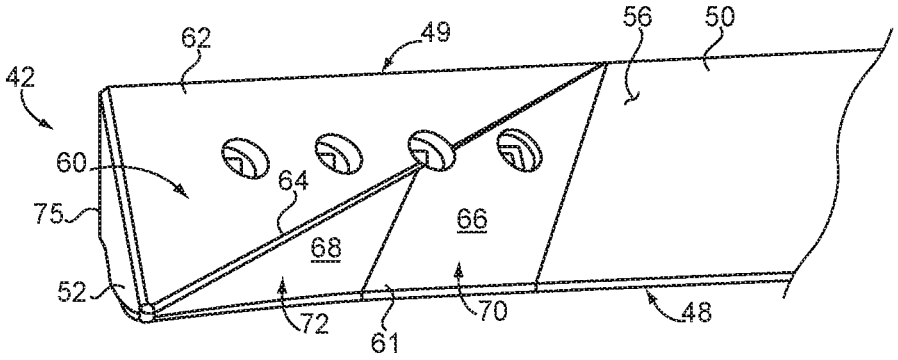
FIG. 6 is an enlarged view of a portion of the body piece of FIG. 4.

Referring also now to FIG. 4, there is shown first outer body section 42 enlarged and illustrating additional details. It can be seen from FIG. 4 that outboard end bit 52 has a length 170 and inboard stem 150 has a length 180. In a practical implementation strategy length 170 may be from about 33 percent to about 50 percent of a total horizontal length of first outer body piece 42. In the embodiment shown in FIG. 4 inboard stem 50 and outboard end bit 52 are formed integrally as a single piece. Referring also to FIG. 6, the curvilinear profile formed by leading edge 48 and the adjoining linear profile formed by leading edge 48 upon outboard end bit 52 and inboard stem 50, respectively, is readily apparent. First outer body piece 42 can be formed as a single casting in some embodiments.

It can also be seen from FIGS. 4 and 6 that outboard end bit 52 includes a compound forward face 60 extending from leading edge 48 to trailing edge 49. Compound forward face 60 includes a lower forward face 61 and an upper forward face 62. A diagonally oriented ridge 64 extends between lower forward face 61 and upper forward face 62, at least in part for purposes of separating flows of material across lower forward face 61 and upper forward face 62. During digging material with dozing blade assembly 16, material cut and sliding on one side of ridge 64 may be directed generally toward the fore-to-aft center line of cutter 34 and dozing blade 18, whereas material cut and flowing across to or against the opposite side of ridge 64 may slide against upper forward face 62 and be directed out and away from cutter 34 and dozing blade 18. Example flow arrow in front of blade 18 in FIG. 1 depict approximate and exemplary directions of separate flow of material upward and inward in contact with lower forward face 61 and upward and outward in contact with upper forward face 62, although the present disclosure is not thusly limited.

In a practical implementation strategy, lower forward face 61 may itself be compound and formed by an inboard section 66 and an outboard section 68. Inboard section 66 and outboard section 68 may be structured to blend forward face 60, or at least lower forward face 61, with outer digging face 56. Lower forward face 61 adjoins leading edge 48, with inboard section 66 being curved to impart a first concave radius of curvature 70 to leading edge 48 at an inboard location, whereas outboard section 68 is curved according to a smaller radius of curvature 72 at an outboard location. The inboard location is adjacent to digging face 56 and the outboard location is adjacent to a terminal outboard end (not numbered) of first outer body piece 42. Radius of curvature 70 and radius of curvature 72 may be the radiuses of curvature formed in an inboard to outboard direction. Inboard section 66 and outboard section 68 may also define concave radiuses of curvature that are different from radiuses of curvature 70 and 72, respectively, in a direction from leading edge 48 to trailing edge 49. It should be understood that the blending of lower forward face 61, more particularly, inboard section 66, with digging face 56 by forming inboard section 66 according to multiple different radiuses, and the blending of outboard section 68 with inboard section 66, can enable the smooth flow of material across and past outboard end bit 52.

Figure 5:
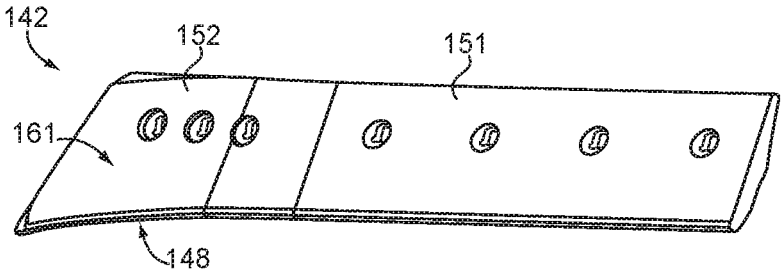
FIG. 5 is a diagrammatic view of a body piece for a cutter in a dozing blade assembly, according to another embodiment.

Referring to FIG. 5, there is shown an outer body section 142 according to a different embodiment, where a stem 151 is attached and/or formed integrally with an outboard end bit 152, and where instead of a compound forward face a relatively smooth and potentially planar, non-compound, forward face 161 is used upon end bit 152. A leading edge 148 is formed in part upon inboard stem 151 and in part upon outboard end bit 152, and has a curvilinear profile upon outboard end bit 152 that transitions with a linear profile upon inboard stem 151 as shown.

Figure 7:
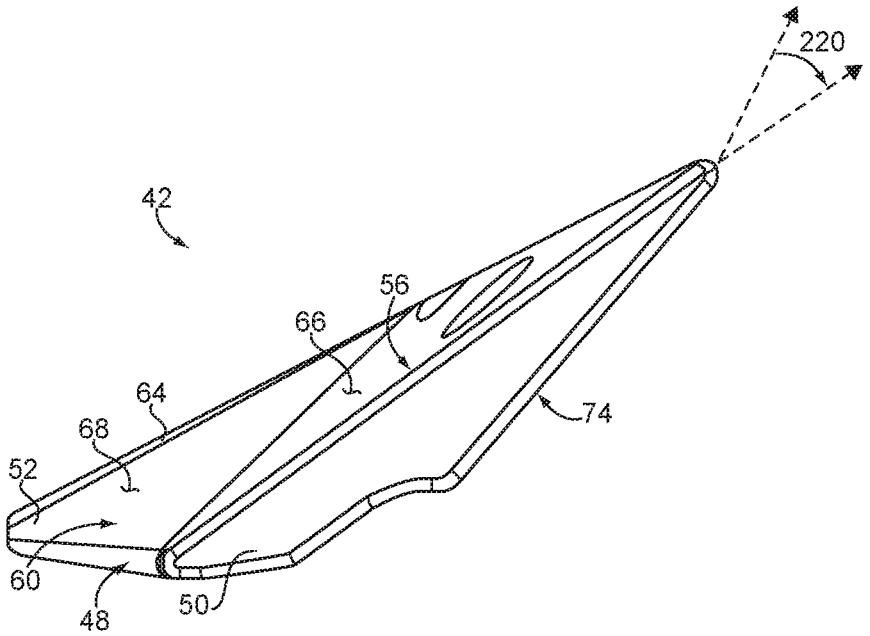
FIG. 7 is an end view of the body piece of FIGS. 4 and 6.
Figure 8:
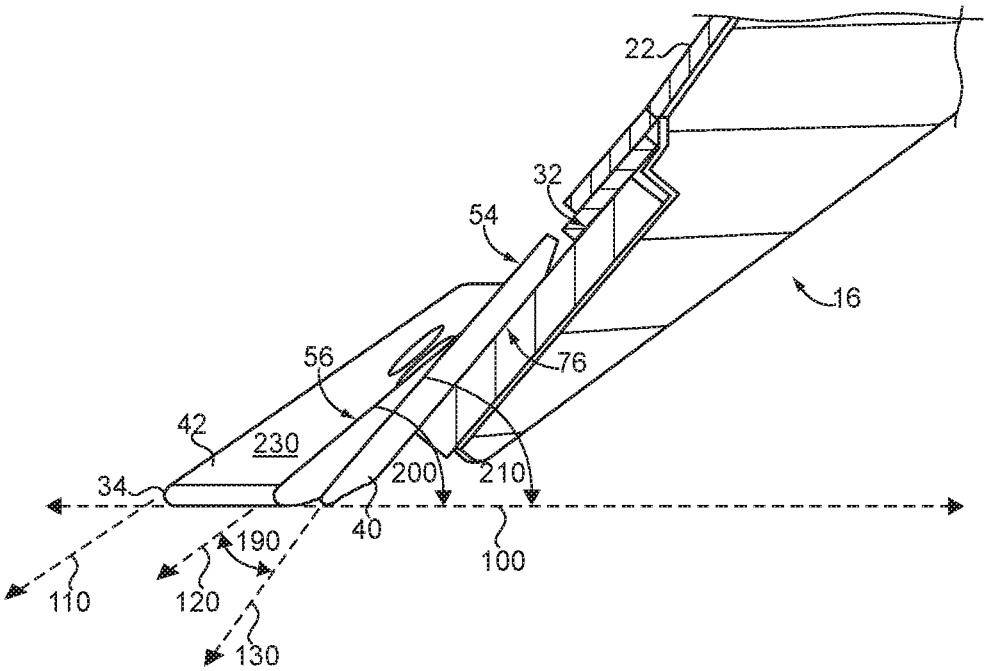
FIG. 8 is a partially sectioned side diagrammatic view of a dozing blade assembly, according to one embodiment.

Referring also now to FIG. 7, there is shown an end view from an inboard side of first outer body piece 42, illustrating additional contours to forward face 60, and also a cross-sectional shape of inboard stem 50. It can be seen that inboard stem 50 includes a back mounting face 74, and as shown in FIG. 6 outboard end bit 52 has a back mounting face 75. It can also be noted that not only are back mounting faces 74 and 75 potentially continuous with one another, or at least co-planar, but also that trailing edge 49 and trailing edge 47 are also parallel, and generally parallel with leading edge 46. In a practical implementation strategy, back mounting face 74 may be oriented at an angle, greater than zero, relative to outer digging face 56. In FIG. 7, the subject angle is denoted via reference numeral 220. Referring also to FIG. 8, there are shown additional geometric features of dozing blade assembly 16, including a back mounting face 76 of middle body piece 40 that is oriented parallel to middle digging face 54. Angle 220 may be understood as a relatively larger angle in comparison to the smaller angle of typically zero, formed by back mounting face 76 and middle digging face 54. Horizontal plane 100 is also shown in FIG. 8. Middle digging face 54 may be oriented at a first angle 210 relative to horizontal plane 100, that may be from about 45 degrees to about 52 degrees. Each of first outer digging face 56 and second outer digging face 58 may be oriented at a second angle shown with respect to first outer body piece 42 in FIG. 8 at reference numeral 200 that is less than first angle 210, and may be about 35 degrees to about 45 degrees. Yet another angle is shown at 230 between outboard end bit 52, and in particular upper forward face 62, and horizontal plane 100. Angle 230 may be smaller still than angle 200, as upper forward face 62 may be oriented at an angle relatively shallower than either of outer digging face 56 or middle digging face 54.

INDUSTRIAL APPLICABILITY

With continued reference to FIG. 8, and referring also back to FIG. 1, there are shown imaginary lines representing approximate planes as might be defined by various surfaces of cutter 34. A first line 110 is generally defined by upper forward face 62, and extends at angle 230 that is shallowest relative to horizontal plane 100. Another line 130 is defined by middle digging face 54 and extends at angle 210 that is relatively steep relative to horizontal plane 100, whereas another line 120 is defined by outer digging face 56 and extends at angle 220 that is intermediate. An angle formed between outer digging face 56 and middle digging face 54 is shown at reference numeral 190 and might be about 10 degrees, for example. Across the full width of dozing blade assembly 16 the leading edges of the components may define a plane.

As dozing blade assembly 16 is moved through material the shape of cutter 34 will produce a reactive force from the material being displaced that tends to urge cutter 34 and thus dozing blade 18 downwardly. As noted above, the relative steepness of different digging faces on cutter 34 can affect the extent to which forces exerted by material being displaced are directed downwardly, versus horizontally in opposition to the forward motion of dozing blade assembly 16. It will be appreciated by those skilled in the art, however, that rather than deciding on one single orientation for a dozing blade cutter, differently oriented sections within the same cutter can provide a superior strategy. It can still further be understood from the foregoing description and attached drawings that cutter 34 is capable of being mounted upon a uniformly planar mounting surface, that accordingly integrates digging, cutting, and pushability advantages into a cutting system suitable for use with relatively smaller dozing blades commonly having a single uniformly planar cutter mounting surface, such as are commonly used with small- to mid-size tractors.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A dozing blade assembly comprising:

a dozing blade including a plurality of rearward positioned mounts for coupling the dozing blade with an implement system in a tractor, and a moldboard facing a forward direction, the moldboard having an upper edge and a lower edge each extending in a horizontal direction, a first outboard edge, and a second outboard edge, and the moldboard forming a concave vertical profile;

the dozing blade further including a substantially planar mounting surface extending along the lower edge and oriented at a uniform angle relative to a horizontal plane;

a cutter supported in a service configuration upon the mounting surface and including an elongate body having a middle body piece, a first outer body piece and a second outer body piece positioned on opposite outboard sides, respectively, of the middle body piece;

the first outer body piece and the second outer body piece being mirror images of one another, and each including an inboard stem having a linear leading edge profile, and an outboard end bit having a curvilinear leading edge profile that transitions with the linear leading edge profile of the corresponding inboard stem;

each of the outboard end bits having a leading edge that forms the curvilinear leading edge profile, a trailing edge, an outboard end surface, and a forward face that extends from the corresponding leading edge to the corresponding trailing edge and the middle body piece including a middle digging face, and a middle mounting face, a leading edge, and a trailing edge, and the middle digging face being oriented at a steeper angle relative to a horizontal plane, and the first outer body piece and the second outer body piece including, respectively, a first outer digging face and a second outer digging face positioned upon the corresponding inboard stem and each oriented at a shallower angle relative to the horizontal plane;

the first outer body piece and the second outer body piece each further including a first outer mounting face and a second outer mounting face positioned opposite, respectively, to the first outer digging face and the second outer digging face;

the middle digging face being oriented at a smaller angle relative to the middle mounting face, and each of the first outer digging face and the second outer digging face being oriented at a larger angle relative to the corresponding first outer mounting face and second outer mounting face.

2. The dozing blade assembly of claim 1 wherein the inboard stem and outboard end bit in each of the first outer body piece and the second outer body piece are formed integrally as a single piece.

3. The dozing blade assembly of claim 2 wherein the forward face of each of the outboard end bits includes a compound forward face.

4. The dozing blade assembly of claim 3 wherein the compound forward face of each of the outboard end bits includes a lower forward face and an upper forward face, and a ridge extending between the lower forward face and the upper forward face to separate flows of material across the lower forward face and the upper forward face.

5. The dozing blade assembly of claim 2 wherein the first outer mounting face and the second outer mounting face include a first back mounting face and a second back mounting face, respectively, oriented at the larger angle, which is greater than zero, relative to the first outer digging face and the second outer digging face.

6. The dozing blade assembly of claim 5 wherein the middle mounting face is oriented parallel to the middle digging face.

7. The dozing blade assembly of claim 1 wherein the middle body piece has a first horizontal length and each of the first outer body piece and the second outer body piece has a second horizontal length that is less than the first horizontal length.

8. The dozing blade assembly of claim 7 wherein the middle digging face is oriented at a first angle relative to the horizontal plane that is from about 45 degrees to about 52 degrees, and wherein each of the first outer digging face and the second outer digging face is oriented at a second angle relative to the horizontal plane that is less than the first angle.

9. A cutter for a dozing blade in an implement system comprising:

an elongate body having a middle body piece, a first outer body piece, and a second outer body piece;

the middle body piece including a middle digging face, a middle mounting face opposite the middle digging face, a leading edge, and a trailing edge;

the first outer body piece and the second outer body piece including, respectively, a first outer digging face and a second outer digging face and a first outer mounting face and a second outer mounting face positioned opposite to the first outer digging face and the second outer digging face;

the first outer body piece and the second outer body piece further being mirror images of one another, and each including an inboard stem having a linear leading edge profile, and an outboard end bit having a curvilinear leading edge profile that transitions with the linear leading edge profile of the corresponding inboard stem;

each of the outboard end bits having a leading edge that forms the curvilinear leading edge profile, a trailing edge, an outboard end surface, and a forward face that extends from the corresponding leading edge to the corresponding trailing edge; and the middle digging face being oriented at a smaller angle relative to the middle mounting face, and each of the first outer digging face and the second outer digging face being oriented at a larger angle relative to the corresponding first outer mounting face and second outer mounting face, such that the middle digging face is more steeply inclined to a horizontal plane than the first outer digging face and the second outer digging face when the cutter is mounted in a service configuration upon a substantially planar mounting surface of the dozing blade.

10. The cutter of claim 9 wherein the middle mounting face is oriented substantially parallel to the middle digging face, and wherein each of the first outer digging face and the second outer digging face is oriented at an acute angle relative to the corresponding first outer mounting face and second outer mounting face.

11. The cutter of claim 9 wherein the inboard stem and outboard end bit in each of the first outer body piece and the second outer body piece are formed integrally as a single piece.

12. The cutter of claim 11 wherein the forward face of each of the outboard end bits includes a compound forward face.

13. The cutter of claim 12 wherein the trailing edge of each of the outboard end bits is oriented parallel to the leading edge of the corresponding inboard stem.

14. The cutter of claim 13 wherein the compound forward face includes a lower forward face adjoining the corresponding leading edge, and an upper forward face.

15. The cutter of claim 14 wherein the lower forward face includes an inboard section that is blended with the corresponding outboard digging face, and an outboard section that is blended with the inboard section.

16. The cutter of claim 15 wherein each of the outboard end bits further includes a ridge extending between the lower forward face and the upper forward face.

17. The cutter of claim 9 wherein each of the first outer body section and the second outer body section includes a body section length, and the each of the outboard end bits comprises from about 25% to about 33% of the corresponding body section length.

18. A cutter for a dozing blade in an implement system comprising:

an elongate body having a middle body piece, a first outer body piece, and a second outer body piece;

the middle body piece including a middle digging face, a middle mounting face opposite the middle digging face, a leading edge, and a trailing edge;

the first outer body piece and the second outer body piece including, respectively, a first outer digging face and a second outer digging face and a first outer mounting face and a second outer mounting face positioned opposite to the first outer digging face and the second outer digging face;

the first outer body piece and the second outer body piece further being mirror images of one another, and each including an inboard stem having a linear leading edge profile, and an outboard end bit having a curvilinear leading edge profile that transitions with the linear leading edge profile of the corresponding inboard stem; and the middle digging face being oriented at a smaller angle relative to the middle mounting face, and each of the first outer digging face and the second outer digging face being oriented at a larger angle relative to the corresponding first outer mounting face and second outer mounting face, such that the middle digging face is more steeply inclined to a horizontal plane than the first outer digging face and the second outer digging face when the cutter is mounted in a service configuration upon a substantially planar mounting surface of the dozing blade;

wherein the inboard stem and outboard end bit in each of the first outer body piece and the second outer body piece are formed integrally as a single piece;

wherein each of the outboard end bits includes a leading edge, a trailing edge, and a compound forward face extending from the corresponding leading edge to the corresponding trailing edge; and wherein the trailing edge of each of the outboard end bits is oriented parallel to the leading edge of the corresponding inboard stem.

19. The cutter of claim 18 wherein:

the compound forward face includes a lower forward face adjoining the corresponding leading edge, and an upper forward face;

the lower forward face includes an inboard section that is blended with the corresponding outboard digging face, and an outboard section that is blended with the inboard section; and each of the outboard end bits further includes a ridge extending between the lower forward face and the upper forward face.

20. The cutter of claim 18 wherein:

the middle body piece has a first horizontal length and each of the first outer body piece and the second outer body piece has a second horizontal length that is less than the first horizontal length;

the middle digging face is oriented at a first angle relative to the horizontal plane that is from about 45 degrees to about 52 degrees; and each of the first outer digging face and the second outer digging face is oriented at a second angle relative to the horizontal plane that is less than the first angle.

* * * * *